US005722488A

United States Patent [19]

Normann et al.

[11] Patent Number: 5,722,488

[45] Date of Patent: Mar. 3, 1998

[54] APPARATUS FOR DOWNHOLE DRILLING COMMUNICATIONS AND METHOD FOR MAKING AND USING THE SAME

[75] Inventors: Randy A. Normann, Edgewood; Grant J. Lockwood; Meliton Gonzales, both of Albuquerque, all of N. Mex.

[73] Assignee: Sandia Corporation, Albuquerque, N. Mex.

[21] Appl. No.: 633,263

[22] Filed: Apr. 18, 1996

[51] Int. Cl.[6] ..... E21B 19/22

[52] U.S. Cl. ..... 166/65.1; 439/932

[58] Field of Search ..... 439/932, 4, 501; 166/65.1

[56] References Cited

U.S. PATENT DOCUMENTS 3,294,941 12/1966 Mullen ..... 439/932 X 5,105,878 4/1992 Forest et al. ..... 166/65.1

5,135,698 8/1992 Salama et al. ..... 264/229

5,234,058 8/1993 Sas-Jaworsky et al. ..... 166/65.1

*Primary Examiner*—William P. Neuder

*Attorney, Agent, or Firm*—Timothy D. Stanley

[57] ABSTRACT

An apparatus for downhole drilling communications is presented. The apparatus includes a spool and end pieces for maintaining the spool at the bottom of a drill string near a drill bit during drilling operations. The apparatus provides a cable for communicating signals between a downhole electronics package and a surface receiver in order to perform measurements while drilling. A method of forming the apparatus is also set forth wherein the apparatus is formed about a central spindle and lathe.

23 Claims, 3 Drawing Sheets

APPARATUS FOR DOWNHOLE DRILLING COMMUNICATIONS AND METHOD FOR MAKING AND USING THE SAME

GOVERNMENT RIGHTS

This invention was made with United States Government support under Contract No. DE-AC04-76DP00789 awarded by the U.S. Department of Energy. The Government has certain rights in this invention.

BACKGROUND OF THE INVENTION

The present invention relates generally to the field of drilling. More specifically, the present invention relates to an apparatus which assists in obtaining high-data-rate measurements during downhole drilling operations by allowing for the extension of communications wire from subsurface sensors to surface monitoring equipment.

In modern drilling operations, whether in the resource, utility or environmental industries, there presently exist many devices and methods for determining the composition of geological sites, drill bit environments, and environmental waste sites. In the environmental remediation industry in particular, drilling for environmental characterization requires operating through boreholes rather than excavating entire sites and treating contaminated soil above ground. If drilled solids contain toxic or radioactive substances, the cost of drilling increases due to worker safety concerns as well as the need to collect, document, dispose of drill cuttings of rock and other subterranean materials brought to the surface, and to decontaminate drilling equipment. Once a contaminated site is characterized, remediation wells must be drilled in which to position barriers, or to inject or pump out toxic subsurface fluids. Such wells must be drilled horizontally or diagonally, a method called directional drilling. Directional drilling is the process of using a drill bit to drill a borehole in a specific direction to achieve a specific drilling objective. Measurements concerning the drift angle, the azimuth, and tool face orientation all aid in directional drilling. Sensor devices can also be normally utilized in directional drilling operations to characterize a given geological or environmental waste site. A need exists for making evasive electronic sensor measurements during such drilling operations.

In a typical directional drilling operation, a hole is drilled at a shallow angle with respect to the surface. Typical drilling equipment utilized in such drilling operations includes a device commonly known in the drilling industry as a "Kelly". A Kelly is a pipe apparatus utilized in drilling operations which can be attached to the top of a drill string and rotated by a drive unit during a drilling cycle. The drill string provides a working interconnected assembly of drill rods, drill collars, and one or more drill bits. The Kelly transmits a twisting torque from accompanying rotary machinery to the drill string and ultimately to the drill bit. The Kelly can in turn be threaded to the first joint of a drill pipe. As the drilling operation progresses, additional joints of drill pipe are added between the drill string and the Kelly. The end of the drill string supports the drill bit and various steering devices which enable drilling in the desired direction. The equipment located at the drill bit, including the steering devices, require that data be transmitted to an operator, which can be accomplished by positioning an electrical cable through the drill string and extending the cable to the Kelly. Each time a joint is added, the electrical conductor or cable must be cut and extra lengths spliced and rethreaded through additional pipe, a time consuming and expensive endeavor. Such a procedure also limits the data transmission rate.

Devices for adding lengths of wire during drilling operations are known. An electrical system including a connector, cable and cartridge for slant hole drilling is described in U.S. Pat. No. 5,105,878 to Forest et al. Forest et al disclose a device for positioning an added length of wire in a drill string. Although Forest et al. disclose a device which reduces the number of cuts of wire necessary for adding wire during a drilling operation, Forest et al. does require at least three or four cuts and subsequent splicing to successfully complete the drilling operation. In addition, the device described by Forest et al. is produced using rigid materials which eliminates flexibility. Cutting and splicing wires, even at a reduction of three or four cuts, remains an expensive proposition. Also, subterranean drill cuttings or extraneous material can be brought to the surface each time a wire is cut and spliced. Particularly in environmental waste sites, such cuttings can be hazardous to humans and animals. In these cases, the drilling operation must be halted until the harmful materials are decontaminated or removed safely from the drill site.

The present invention solves the problem of cutting and splicing electrical cables and wires utilized in drilling operations by disclosing a compressed, elongated and flexible wiring shell that can be used in downhole drilling systems, especially for high-data rate measurements performed while drilling. Unlike existing cable spooling systems utilized in drilling operations which are located at the surface or upon a surface drilling platform, the present invention which locates a spool of communications cable within a drill string. The apparatus described by the present invention provides a communications cable connected to a downhole electronics package and a surface receiver. The apparatus is located at one end of a drill string near a drill bit during a drilling operation, disclosing a unique mechanism which is a simpler, flexible and inexpensive advance over the prior art.

SUMMARY OF THE INVENTION

The present invention provides an apparatus for downhole drilling communications which enables cable or wire to extend from one end of a drill string to the other end thereof during a drilling operation. The apparatus comprises a spool of communications cable mounted within the drill string that can be unspooled as the drill string advances into the earth during a drilling operation. The spool has a central interior cavity with the communications cable wound within the cavity in the form of a coil. End pieces are connected to the front end and the back end of the spool, and each end piece has a passageway larger than the diameter of the communications cable through which opposite ends of the communications cable can pass. The end pieces can be formed of a nonbinding material such as teflon. The communications cable has an outer jacket which can also be comprised of a similar nonbinding material.

The present invention further includes a method for extending an communications cable from a drill string package located in a borehole to a drilling platform and includes the steps of positioning a spool of communications cable at one end of a drill string prior to a drilling operation, and connecting the first end of the cable to a drilling sensor package located within the drill string. A second end of the communications cable is connected to the drilling platform on the surface. The spool can be locked in an immovable position within the drill string near the drill bit and the communications cable is unspooled as additional sections of drill rod are added to the drill string.

The present invention also discloses a method for forming a spool of communications cable. A coil of communications cable is wound on a spindle having a first end and a second end. The spindle itself is located on a lathe and the communications cable can be wound thereon. A first end piece is mounted at the first end of the spindle and a second end piece is mounted at the second end of the spindle. Each end piece has a passageway therethrough. The inner diameter of each end piece passageway is slightly larger than the diameter of the spindle. Shrinkable elastic material is placed over the coil of communications cable and the end pieces and heat is applied so that the shrinkable elastic material encapsulates the coil and the end pieces. The coil of communications cable, spindle and end pieces can be removed from the lathe upon completion of the coiling operation. The spindle can then be removed through one end piece passageway.

The present invention provides a novel communications cable system for unspooling cable from the bottom of a drill string during a drilling operation. Additional advantages and novel features will become apparent to those of ordinary skill in the art upon examination of the following detailed description of the invention or can be learned by practice of the present invention. Accordingly, the present invention accomplishes the foregoing by providing a means for unspooling communications cable located at the bottom of a drill string near a drill bit.

Further scope of applicability of the present invention will become apparent from the detailed description of the invention provided hereinafter. It should be understood, however, that the detailed description of the invention and the specific examples presented, while indicating embodiments of the present invention, are provided for illustration purposes only because various changes and modifications within the spirit and scope of the invention will become apparent to those of ordinary skill in the art from the detailed description of the invention and claims that follow.

BRIEF DESCRIPTION OF THE DRAWINGS

FIG. 3(*b*) shows the second step of a drilling operation which incorporates the apparatus for downhole drilling electrical communications.

FIG. 3(*c*) shows the third step of a drilling operation which incorporates the apparatus for downhole drilling electrical communications.

FIG. 3(*d*) shows the fourth step of a drilling operation which incorporates the apparatus for downhole drilling electrical communications.

DETAILED DESCRIPTION OF THE INVENTION

Figure 1:
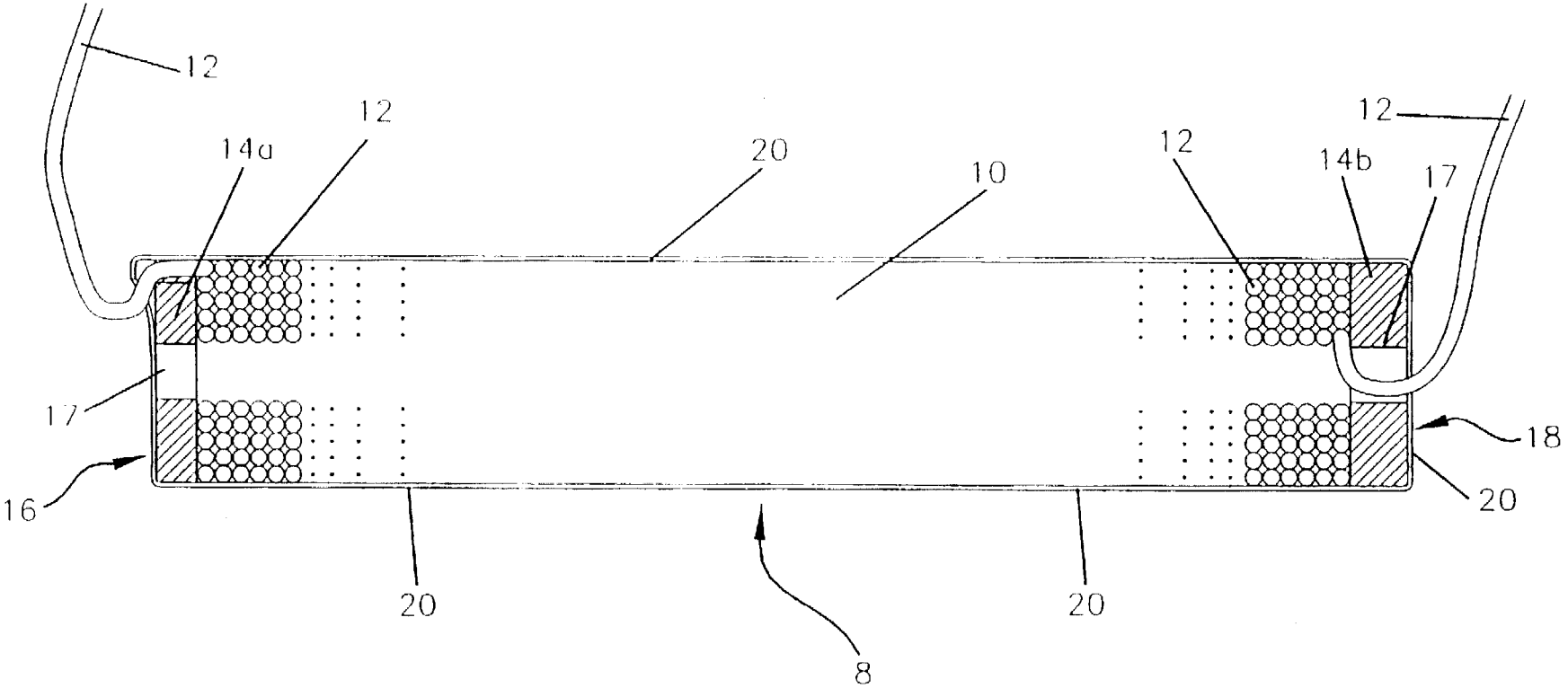
FIG. 1 shows a side view of an apparatus for use in electrical measurements taken during drilling operations.

Attention is now directed to FIG. 1 where an apparatus 8 for downhole drilling communications is shown. The apparatus 8 includes a spool 10 composed of a length of coiled cable 12. The amount of cable 12 can vary depending on the desired depth to be drilled during a drilling operation. The cable 12 can include cable adapted for electrical and fiber optics communications. The spool 10 will typically store enough cable 12 to span the desired depth of a drilling operation. The spool 10 itself can be manufactured for different cable lengths. The spool 10 can, for example, include 1000 feet or more of communications cable. The communications cable can be coaxial cable or fiber optic cable. The actual storage capacity of the spool 10 is a scale factor depending on the size of the cable, the length of the spool 10 and its diameter.

Two end pieces 14*a* and 14*b* are located at a front end 16 and a back end 18 of the spool 10 shown in FIG. 1. The end pieces 14*a* and 14*b* include passageway 17 which allows cable 12 to be extracted from the interior of the spool 10. The end pieces 14*a* and 14*b* prevent cable 12 from pulling away from the apparatus 8. The end pieces 14*a* and 14*b* are preferably made from a nonbinding material such as teflon, and possess an outer diameter that is slightly larger than the diameter of the spool 10. This larger diameter enables the end pieces 14*a* and 14*b* to fit tightly about the ends of the spool 10. The end pieces 14*a* and 14*b* are positioned on the ends of spool 10 in order to allow for the extension of cable 12 housed within the apparatus 8. The cable 12 has an outer jacket which can also be made from a nonbinding material such as teflon. The use of such a nonbinding material, although not a necessary limitation of the present invention, prevents the cable 12 from sticking to itself as it is unwound from the apparatus 8, preventing potential entanglement and "bird nesting" of the cable 12, a problem associated with existing downhole drilling electrical communication mechanisms. The cable 12 itself is unwound during a drilling operation from the interior of the apparatus 8 which further prevents entanglement and "bird nesting."

The process creating the apparatus 8 can be accomplished at a typical coil or transformer winding shop. The cable 12 is preferably wound on a spindle (not shown) using a lathe so as to form spool 10. The diameter of the spindle is the same as the inside diameter of the finished spool 10. The spindle holds the coil of communications cable 12 and the two end pieces 14*a* and 14*b* in place during the winding process.

The cable 12 can be wound an odd number of layers in forming spool 10 so that opposite ends of cable 12 are positioned opposite one another. By positioning the ends of the cable 12 opposite one another in this manner, problems associated with down hole termination and uncabling can be avoided. The cable 12 is wound on the spindle such that one end thereof can be pulled from the interior of the spool 10. However, positioning of the cable ends opposite one another is not a necessary limitation of the present invention. The cable 12 can be wound an even number of layers and yet function as designed. The cable 12 can be wound with many layers. It is not necessary to limit the cable 12 to a single layer. For example, hundreds of turns can be wound into a single layer. Further layers can be added depending upon the desired length of cable 12 needed to span the length of drill rods during a given drilling operation.

Shrink tubing 20 is placed over the coiled cable 12 and end pieces 14*a* and 14*b*. Shrink tubing 20 is tubing which reduces in diameter and conforms to the shape of the object it surrounds by the application of heat. A heat gun or another similar heating device can be utilized to apply heat to the shrink tubing 20. As heat flows from the heat gun to the shrink tubing 20, the tubing 20 will reduce in diameter and contract to encapsulate cable 12 and end pieces 14*a* and 14*b*. The spindle can then be removed from the center of the spool 10 through one of the passageways 17 in either end piece 14*a* or 14*b*. Shrink tubing 20 or other similar elastic material are used to maintain stability of the structure of the apparatus 8 in the event that the apparatus 8 experiences vibration or bending during a drilling operation. The shrink tubing 20 essentially creates an inexpensive, custom molded container and maintains a small amount of constant elastic pressure against the coiled cable 12 thus retaining the general shape of spool 10.

With the shrink tubing 20 in place about the spool 10, the spool 10 can bend and continue to function without experiencing elastic problems. The shrink tubing 20 will retain a hold on the cable 12 and create a slight stabilizing inward pressure, effectively maintaining the structure of the apparatus 8 without the use of adhesives and other bonding materials. Such adhesives and bonding materials are likely to deteriorate under the stress and pressure of drilling. The shrink tubing 20 also acts to protect from abrasion the cable 12 contained within the apparatus 8. This is particularly important when using drilling fluid. Contact with drilling fluid is expected during these type of drilling operations and a flexible protective material such as shrink tubing 20 serves to protect the cable 12 contained within the apparatus 8.

Figure 2:
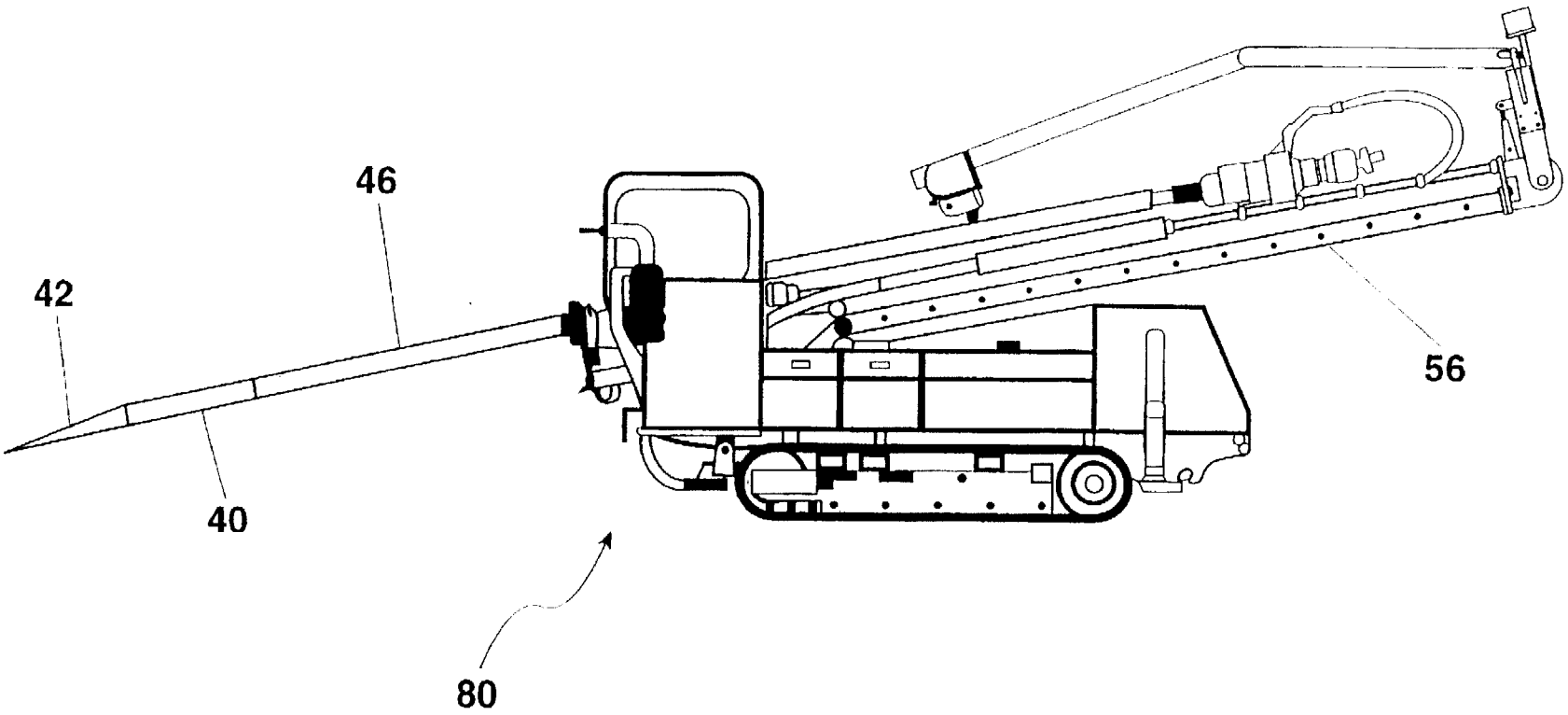
FIG. 2 shows a side view of a boring rig and the location of the apparatus for downhole electrical communications.
Figure 3A:
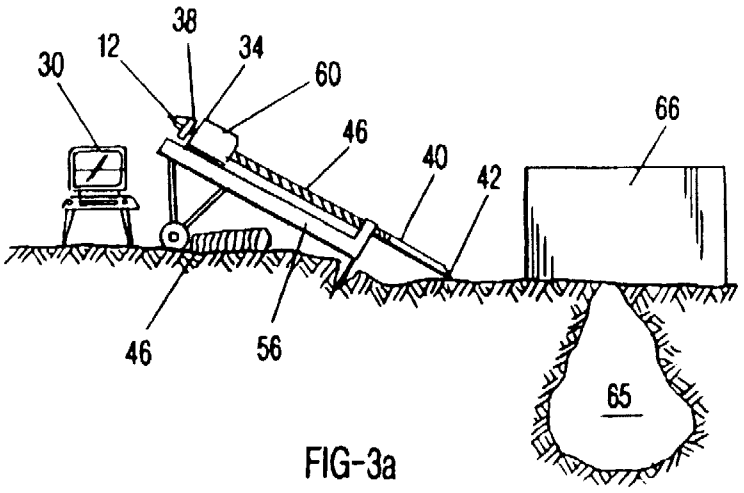
FIG. 3(*a*) shows the first step of a drilling operation which incorporates the apparatus for downhole drilling electrical communications.
Figure 3B:
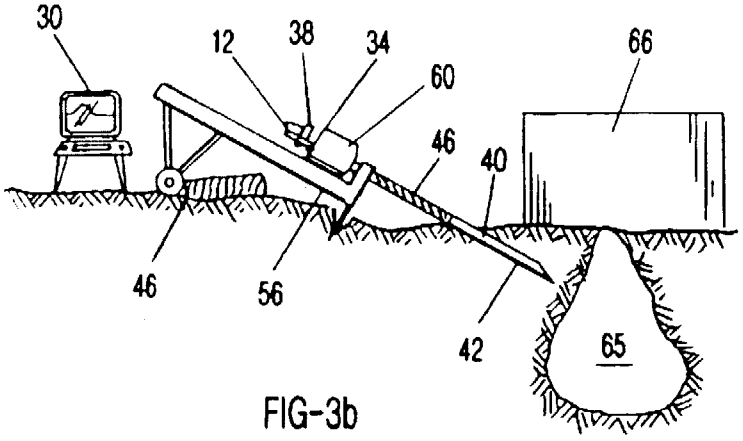
Figure 3C:
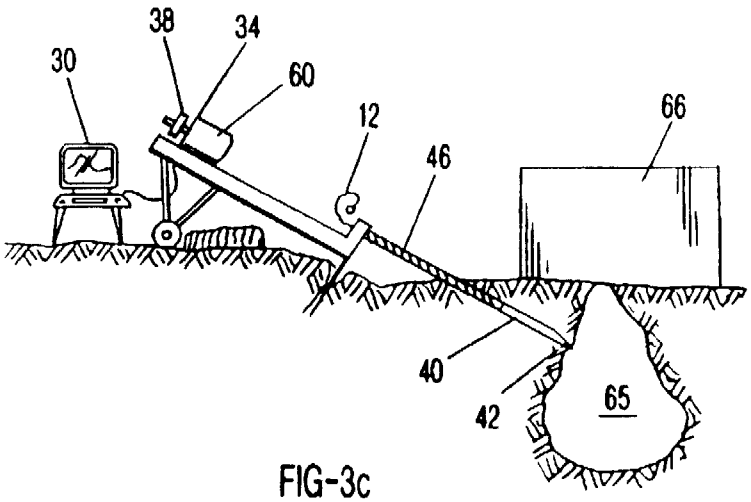
Figure 3D:
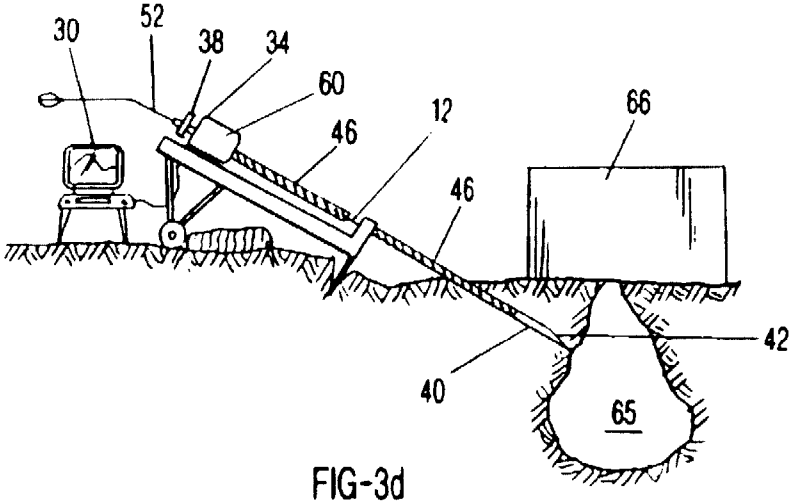

FIG. 2 shows a directional drilling rig 80 of the type commonly used in the drilling industry. It is typically mounted on a flat bed trailer which is sloped or tilted at a requisite angle to cause a Kelly (not shown) to align at a particular angle with respect to the horizon. A standard drill bit 42 and a drill rod 46, comprising a drill string, protrude from a drilling platform 56 located on the drilling rig 80. The Kelly is powered by a power plant in a fashion believed to be well known. The drill string is made up of individual joints of pipe, and there is a drill bit 42 located at the remote end of the drill string. The drill bit 42 typically is installed in conjunction with various steering tools. In general terms, the equipment at the drill bit 42 requires electrical power for operation. Accordingly, an electrical conductor can be strung through the drill string. An electronics sensor package for measuring subsurface characteristics, along with apparatus 8, can be located in the drill string at the drill bit 42 and interior to the drill rod 46. The apparatus 8 is placed at the remote end of the drill string near the drill bit 42.

FIGS. 3(*a*) to 3(*d*) show an embodiment of the present invention applied to a typical drilling operation in which the directional boring rig 80 of FIG. 2 can be utilized. In this embodiment, the apparatus 8 of FIG. 1 is located near the drill bit 42 of FIGS. 3(*a*) to 3(*d*). As the drilling operation proceeds, the drill string moves progressively into the earth. The drill bit 42 and apparatus 8 are positioned together within the drill string. Cable 12 protrudes from both ends of the apparatus 8. An electronic sensor package is located in housing 40 within the drill string and also includes communications apparatus 8. One end of cable 12 of apparatus 8 can be connected either directly to the electronics sensor package or indirectly by means of an intermediary conductor. The other end of cable 12 can be connected to a battery pack and magnetic coil package 38 attached to a hydraulic head 60 of the type commonly used in the drilling industry and as shown in FIG. 3(*a*).

FIG. 3(*a*) shows a drilling system positioned on the surface prior to the start of a drilling operation. A plume 65 is positioned below the surface of the earth. The drill bit 42 will eventually enter the plume 65 during a drilling operation. A plume is a space in the earth or soil containing pollutants or contaminants released from a waste container 66. In this case a plume 65 lies below waste container 66. FIG. 3(*b*) shows a drill rod 46 as it is pushed by a drilling platform 56 into the earth and toward the plume 65. In FIG. 3(*c*), the hydraulic head 60 is pulled back, after cable 12 has been disconnected from the battery pack and magnetic coil package 38. Additional sections of drill rod 46 can be added to allow the drill bit 42 to proceed further into the earth. The cable 12 need not be cut and spliced as extra lengths of drill rod 42 are added. FIG. 3(*d*) shows the cable 12 as it is pulled through an additional section of drill rod 46.

The basic drilling system includes a drilling platform 56, a computer 30, a magnetic pick up and receiver coil package 34, a battery pack and magnetic coil package 38, and a down hole electronics package located in housing 40 near the drill bit 42. Such a down hole electronics package can include several sensors or more for monitoring the environment of the drill bit and drilling conditions in general. The battery pack and magnetic coil package 38 provide both direct-current power and alternating-current signal paths between the drilling platform 56 and the down hole electronics package located in housing 40. The magnetic pick up and receiver coil package 34 also eliminates the need for mechanical rotating contacts because the battery pack and magnetic coil package 38 itself rotates.

As the drill string is lengthened by adding a new drill rod section 46, the cable 12 can be unspooled. A pull rod 52 for pulling the cable 12 from the spool can be located near the battery pack and magnetic coil package 38. The addition of the pull rod 52 assists in extending the cable 12 from apparatus 8 and toward the surface when a new drill section 46 is added. The cable 12 couples an alternating-current signal downhole electronics package located at the drill bit 42 with the rotating battery pack and magnetic coil package 38 mounted on the drilling platform 56. The stationary magnetic pick up and receiver coil package 34 converts the alternating-current signal into a serial bit stream which is communicated to the computer 30. The computer 30 can be equipped with a telemetry serial card for receiving data and can display down hole measurements in real time.

The particular values and configurations discussed herein can be varied and are cited merely to illustrate one embodiment of the present invention and are not intended to limit the scope of the invention. Other variations and modifications of the present invention will be apparent to those of ordinary skill in the art, and it is the intent of the appended claims that such variations and modifications be covered. It is contemplated that the use of the present invention can involve components having different characteristics as long as the principle, the presentation of an apparatus for downhole drilling electrical communications utilizing communications cable during measurements performed during a drilling operation, is followed. It is intended that the scope of the present invention be defined by the claims appended hereto.

I claim:

1. An apparatus for use in downhole drilling communications, comprising:

a spool of communications cable sized to fit within a drill string; and a layer of thermally contractive elastic material which partially encapsulates the spool.

2. The apparatus of claim 1 wherein the cable is electrically conducting cable.

3. The apparatus of claim 1 wherein the cable is fiber optic cable.

4. The apparatus of claim 2 wherein said cable has an outer jacket formed of a nonbinding material.

5. The apparatus of claim 1 wherein the spool of communications cable comprises an odd number of layers of communications cable whereby opposite ends of the communications cable are at opposite ends of the spool.

6. The apparatus of claim 4 wherein the nonbinding material comprises teflon.

7. A method for forming an apparatus for use in downhole drilling electrical communications, comprising the steps of:

coiling communications cable on a spindle;

placing a first end piece at one end of the spindle and a second end piece at the other end of the spindle, wherein the diameter of the first end piece is larger than the diameter of the first end of the spindle and the diameter of the second end piece is larger than the diameter of the second of the spindle;

placing thermally contractive elastic material over the coil and the end pieces;

applying heat to the shrinkable elastic material to encapsulate the coil and the end pieces; and removing the spindle from the coil to form a finished wound coil.

8. The method of claim 7 wherein the finished wound coil has an inside diameter and an outside diameter.

9. The method of claim 8 wherein the spindle has a measurable thickness.

10. The method of claim 9 wherein the thickness of the spindle is equivalent to the inside diameter of the finished wound coil.

11. The method of claim 7 wherein the cable is electrically conducting cable.

12. The method of claim 7 wherein the cable is fiber optic cable.

13. The method of claim 7 wherein the coil is wound an odd number of turns and with multiple layers.

14. The method of claim 7 wherein the coil is wound an even number of turns and with multiple layers.

15. The method of claim 7 where the shrinkable elastic material comprises shrink tubing.

16. A method for extending a cable from a drill string package located in a borehole to a drilling platform on the surface, comprising the steps of:

positioning a spool of communications cable in a drill string prior to a drilling operation;

connecting cable from a first end of the spool to a drilling sensor package located within the drill string, wherein the drilling sensor package is located near a drill bit;

connecting cable from a second end of the spool to the drilling platform;

locking the spool in an immovable position within the drill string near the drill bit; and unspooling cable from the spool while at least one drill rod is added to the drill string.

17. The method of claim 16 wherein the cylindrical spool is flexible and wherein the drilling means comprises a drilling rig located atop a surface drilling platform.

18. The method of claim 17 further comprising the step of pulling the cable from the interior of the spool.

19. The method of claim 18 wherein the cable is wound in the spool in the form of a coil.

20. The method of claim 19 further comprising the step of connecting the cable to a magnetic pick-up coil.

21. The method of claim 16 wherein the cable is electrically conducting cable.

22. The method of claim 16 wherein the cable is fiber optic cable.

23. The method of claim 16 wherein the spool is elongated and cylindrically shaped.

* * * * *